US007314117B2

(12) United States Patent
Finschi

(10) Patent No.: US 7,314,117 B2
(45) Date of Patent: Jan. 1, 2008

(54) METHOD FOR ACHIEVING DESIRED PERFORMANCE OF AN ELEVATOR INSTALLATION

(75) Inventor: Lukas Finschi, Lucerne (CH)

(73) Assignee: Inventio AG, Hargiswil NW (CH)

( * ) Notice: Subject to any disclaimer, the term of this patent is extended or adjusted under 35 U.S.C. 154(b) by 588 days.

(21) Appl. No.: 10/787,428

(22) Filed: Feb. 26, 2004

(65) Prior Publication Data

US 2004/0178021 A1 Sep. 16, 2004

(30) Foreign Application Priority Data

Mar. 10, 2003 (EP) ..... 03405163

(51) Int. Cl.
*B66B 1/28* (2006.01)

(52) U.S. Cl. ..... 187/247; 187/391

(58) Field of Classification Search ..... 187/391–394, 187/247

See application file for complete search history.

(56) References Cited

U.S. PATENT DOCUMENTS

| | | | | |
|---|---|---|---|---|
| 4,330,838 A | | 5/1982 | Yoneda et al. | |
| 4,401,192 A | | 8/1983 | Trosky et al. | |
| 4,458,788 A | | 7/1984 | Lepore | |
| 5,283,399 A | * | 2/1994 | Fujino et al. | 187/382 |
| 5,307,903 A | * | 5/1994 | Morita et al. | 187/382 |
| 5,750,946 A | * | 5/1998 | Thangavelu | 187/392 |
| 6,325,179 B1 | | 12/2001 | Barreiro et al. | |

FOREIGN PATENT DOCUMENTS

| | | |
|---|---|---|
| EP | 0 838 424 | 4/1998 |
| EP | 1 125 881 | 8/2001 |
| JP | 3297764 | 12/1991 |
| JP | 7323974 | 12/1995 |
| JP | 2002109446 A | 4/2002 |

OTHER PUBLICATIONS

Phillips, R.S., "Electric Lifts", 1951, pp. 1-24, 318-323.
MD5 message-digest algorithm, Network Working Group Request for Comments, RFC 1321, Apr. 1992.
Ascheuer et al.: Combinatorial Online Optimization, Sep. 1998, Konrad-Zuse-Zentrum fur Informationstechnik Berlin (pp. 7-11).

* cited by examiner

*Primary Examiner*—Jonathan Salata
(74) *Attorney, Agent, or Firm*—Fraser Clemens Martin & Miller LLC; William J. Clemens

(57) ABSTRACT

A method for the operation of an elevator installation, wherein the operating parameters for achieving a desired performance are determined by simulation of the operation of the elevator installation, the operating parameter and the desired performance are included in a protocol, the elevator installation is operated with the operating parameter, the actual performance produced by the elevator installation is measured and the actual performance is compared with the desired performance.

7 Claims, 2 Drawing Sheets

METHOD FOR ACHIEVING DESIRED PERFORMANCE OF AN ELEVATOR INSTALLATION

BACKGROUND OF THE INVENTION

The present invention relates to a method for the operation of an elevator installation using operating parameters determined by simulation and/or calculation to define a desired performance prior to installation and comparing the desired performance with the actual performance after installation.

Elevator installations which are to be newly constructed or to be modernized are often presented by a customer as a request for a quote and characterized by different specifications, such as, for example:

- the number of stops served,
- the distance from one stop to the next,
- the number of persons to be served at a stop,
- the number of elevators in the elevator installation under consideration,
- the kind of elevator control and passenger interfaces,
- a passenger traffic, for example by a number, which is selected in dependence on the number of persons to be served at a stop, of calls per floor and random destination floors,
- and per elevator:
  - the stops served by the elevator,
  - the kind of drive (for example, the maximum speed, data with respect to graphical travel plot, for example by means of acceleration and jolt or travel times between stops or specific distances),
  - the kind of car (for example, number of decks, size, maximum load weight, maximum number of persons), and
  - the kind of car doors (for example, width, opening time, time for keeping open and closing time).

Such specifications define operating parameters of the elevator installation, by which there are understood physical conditions and relationships which influence and determine the operation and the performance of an elevator installation.

The customer places high demands on an elevator installation. Different performance characteristics of an elevator installation can, in accordance with the current state of the art, be measured with a given passenger traffic or determined by means of simulation or other computation methods, such as, for example:

- the number of the passengers served in a specific time segment,
- per passenger:
  - the time which the passenger needs in order to go from his or her starting stop to his or her destination stop by means of the elevator installation (destination time),
  - the time between the call placed by him or her—or his or her arrival at the installation—up to arrival of the elevator car serving him or her (waiting time),
  - the number of stops during the travel from the starting stop to the initial stop, and
- statistically derived values (for example, mean values) of the above-mentioned magnitudes.

A totality of such performance characteristics forms the desired performance of the elevator installation, which is typically discussed for several months with a customer before construction of the elevator and negotiated in a technical and commercial sense.

It is disadvantageous that a desired performance is often stated to the customer, the fulfillment of which in the constructed elevator installation is difficult to check.

SUMMARY OF THE INVENTION

It is the object of the present invention to improve a method for the operation of an elevator installation in such a manner that the desired performance predetermined and specified before construction of the elevator installation can be checked in a clearly prescribed form after construction of the elevator installation.

In the case of request for quote of a elevator installation the appropriate performance characteristics are determined by means of simulation of the operation of the elevator installation or by another calculation method, which characteristics are, for example, employed technically for the dimensioning of the installation and on the marketing side in the consultative or sales negotiation. Several commercially available software programs for the simulation or other computed representations of the operation of elevator installations are known.

In the method according to the present invention for the operation of an elevator installation at least one operating parameter for achieving a desired performance is initially ascertained by simulation of the operation of the elevator installation and/or by a calculation and acquired together with this desired performance. Optionally this takes place in a protocol.

The protocol is the output, which is produced in the form of an electronic file and/or a document, of the simulation or calculation of the operation of the elevator installation, which combines the established, calculated and/or simulated operating parameters and the predetermined target performance of the elevator installation.

The elevator installation is, after being set up, operated in accordance with the specifications with the previously simulated operating parameters or passenger traffic and the actual performance produced by the elevator installation in that case is measured and compared with the predetermined desired performance. It can thereby be unambiguously recognized and checked whether desired performance and actual performance actually correspond, whether the elevator installation effectively fulfils the requirements of the build project and whether the simulations and/or calculations can correctly predict the operation of the elevator installation.

The desired performance thus consists of performance characteristics, here also called guaranteed value, which is collected and preferably fixed in an electronic file and/or in a document, for example in a guarantee certificate.

Dissatisfaction and disputes on the part of the customer are avoided in every case because it is apparent whether the contractual definitions have been maintained or not.

In a preferred form of embodiment of the present invention the simulation or calculation of the operation is carried out on a computer installation, with a computer program which is loaded into a memory of the computer installation, by a processor of the computer installation which executes the computer program, wherein the desired performance is linked by way of a simulation rule and/or computation rule with the operating parameters and the passenger traffic. The results delivered by the simulation and/or calculation are thereby made available more quickly and with a greater degree of accuracy and reproducibility.

In a further preferred form of embodiment the protocol comprises a falsification protection which prevents the operating parameters, specifications, passenger traffic and/or desired performance from being changed unnoticed. In another preferred form of embodiment the protocol contains an expiration date which ensures that claims derived from the protocol are valid only during a restricted period of time. In yet a further preferred form of embodiment parts of the operating parameters, such as, for example, the passenger traffic or the protocol, are not disclosed or are disclosed only in part; in this manner it is made possible, for example, that details of the control of the elevator installation remain secret or that data which is unimportant for the customer does not have to be comprehensively represented.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
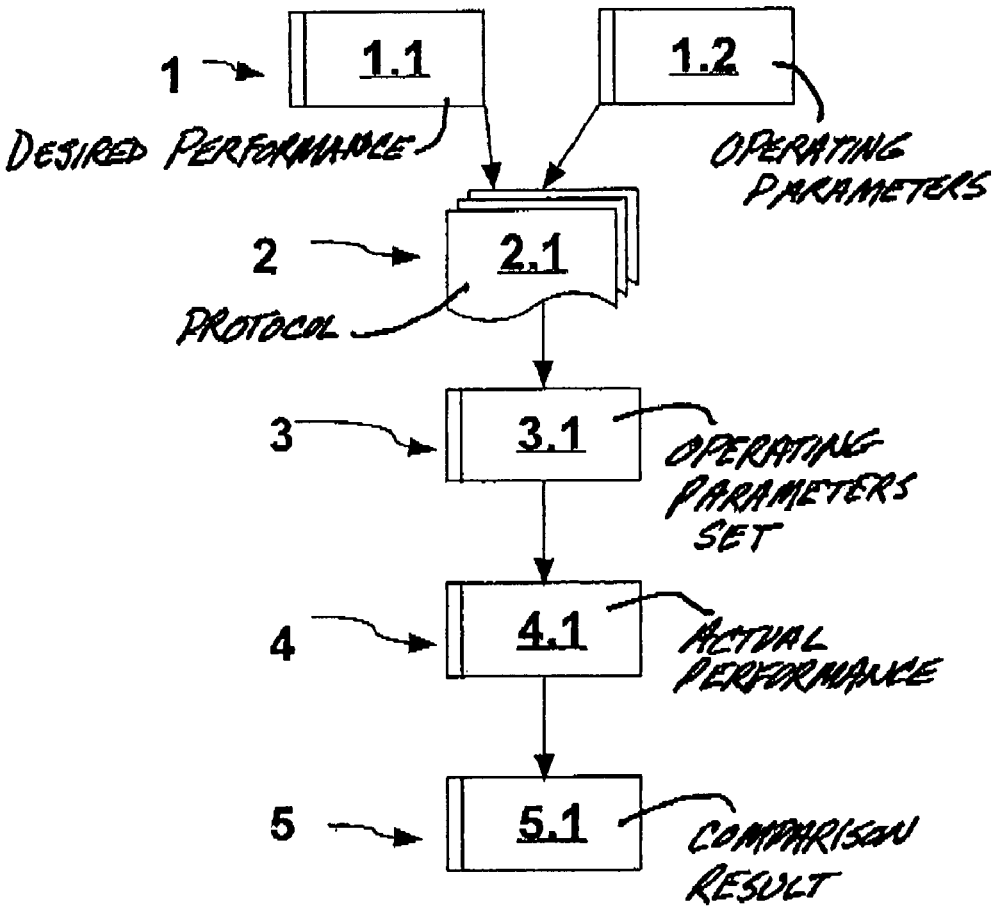
FIG. 1 is a schematic illustration of the method for operation of the elevator installation according to the present invention.

FIG. 1 shows the sequence of the method steps for operation of the elevator installation according to the present invention.

In a method Step 1 the requisite specifications of the elevator installation are initially detected as well as a passenger traffic established. Simulation or another calculation method can be used for that purpose. Operating parameters 1.2 for achieving a desired performance 1.1 can be determined by simulation of the operation of the elevator installation. The determination is preferably carried out by iterative steps. Start operating parameters and specifications of the elevator installation are established and the corresponding performance of the elevator installation is calculated by simulations. When this performance corresponds with the desired performance of the elevator installation, the operating parameters 1.2 for attainment of the desired performance 1.1 have already been found. Otherwise, other start operating parameters and specifications of the elevator installation are established and the corresponding performance of the elevator installation is further calculated by simulations. Conduct of this "trial and error" procedure is continued until the demands of the desired performance are fulfilled.

In a preferred embodiment, in the method Step 1 the simulation and/or calculation of the operation of the elevator installation according to the specifications and the passenger traffic is performed on a computer installation, by a computer program, which is loaded in a memory of the computer installation, by a processor of the computer installation which executes the computer program, wherein the simulated or calculated performance characteristics are linked by way of a simulation rule and/or calculation rule with the operating parameters, the specifications and the passenger traffic. For example, an iterative change of at least one operating parameter is carried out in order to achieve a desired target performance with the computer program. Preferably, an optimization is carried out in which, from a plurality of possibilities, only one or, at least, preferred—for example according to predetermined objective criteria—best-possible changed operating parameters are used. This optimization is repeated until the operating parameters fulfil the requirement of the desired performance.

If, for example, the simulations have the result that three elevators per group are not sufficient for the desired number of served passengers, a further simulation with four elevators per group is carried out. If this simulation again has the result that four elevators per group are not sufficient for the desired number of served passengers, yet a further simulation with another form of elevator control is carried out, for example with a destination call control.

In a method Step 2, on call-up of a corresponding function there is created a guarantee certificate in which on the basis of the specifications, the passenger traffic and the simulated or calculated performance:

- guaranteed values for the performance characteristics of an installation set up in correspondence with the specifications are determined, for example in that the specifications or the simulated or calculated values of the performance characteristics are diminished by a specific relative and/or absolute proportion (factor), and
- one or more files in the form of a protocol 2.1 are created, which embrace the specifications, passenger traffic, derived performance characteristics and guaranteed values.

Figure 2:
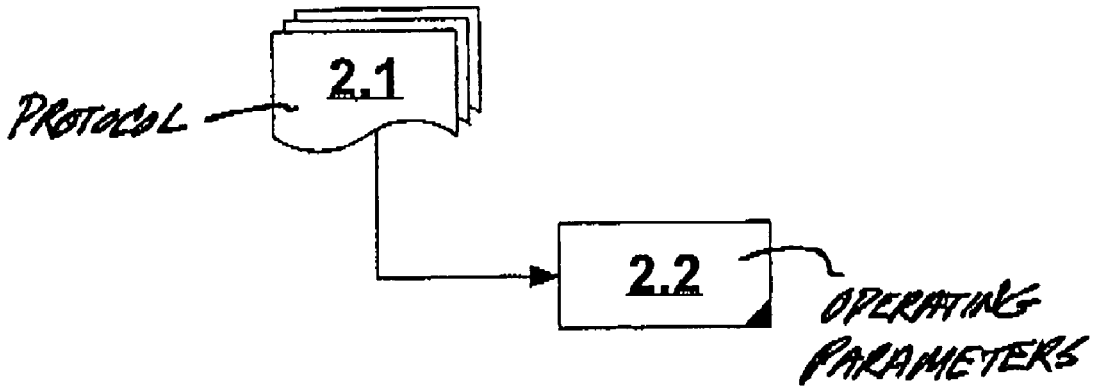
FIG. 2 is a schematic illustration of a set of operating parameters in a protocol of the present invention.

The protocol 2.1 can consist of several sets of operating parameters 2.2, i.e. specifications, passenger traffic, derived performance characteristics as well as guaranteed values, as shown in FIG. 2.

The guarantee certificate is issued to the customer. An expiration date can allow claims, which are derived from the guarantee certificate, only for a restricted time.

When the elevator installation is realized in accordance with the specifications, a verification for the customer can be effected by the guarantee certificate.

In a method Step 3 a set of operating parameters 3.1 is selected from the protocol 2.1, which set is characterized by a predetermined passenger traffic.

The elevator installation is then operated in the method Step 3 with the operating parameters 3.1 in a reference operation. The passenger traffic is already known as an operating parameter. All passenger calls registered in the corresponding passenger traffic are input not by way of the button panel in the car or at the floor, but from the protocol directly into the control.

In a method Step 4 the actual performance 4.1 of the elevator installation is measured.

The passenger calls as well as movements of cars and doors are detected in a measurement protocol. The movements of cars and doors can be observed at the same time by the customer and be independently logged. The measurement protocol is then evaluated, preferably by means of a protocol analyzer.

The protocol analyzer is normally a fixedly predetermined method, which is transcribed in the form of a computer program and which reads, checks and compares the measurement protocol and the guarantee certificate and ultimately delivers information whether the actual performance corresponds with the desired performance.

The protocol analyzer typically reads the data and operating parameters which are contained in the measurement protocol and which are present in the form of a list in a text file or in an "Excel" table and have been effectively measured during the reference operation of the elevator installation. The protocol analyzer initially examines the consistency of these data and checks whether the operational and physical conditions for operation of the elevator installation have been effectively maintained. It thereafter calculates from the measurement protocol the performance characteristics of the elevator installation (waiting times, destination times, etc.). The protocol analyzer also reads the data and operating parameters, which are contained in the guarantee certificate and correspond with the desired performance of the elevator installation, and compares these values with the values derived from the measurement protocol. It ultimately delivers a summary of the results and confirms whether the actual performance of the elevator installation fulfils the conditions predetermined in the desired performance.

An actual performance 4.1 of the elevator installation is compared in a method Step 5 with the desired performance 1.1 or the measured performance characteristics and the measured values are compared with the guarantee declarations contained in the guarantee certificate.

The result of the comparison 5.1 enables formulation of definitive, checkable, reliable and unambiguous statements whether the elevator installation fulfils the specifications and requirements provided in the desired performance.

The passenger traffic is preferably fixed in such a manner that a high performance of the elevator installation can be evidenced, but not too high so that deviations between simulation and realized installation do not have too strong effects on the values of the performance characteristics. This could be assisted by an appropriate simulation method and/or calculation method which on the basis of the specifications produces or produce an appropriately feasible passenger traffic.

The guarantee declarations are based on the values ascertained by means of simulation and/or calculation, for example with respect to:

minimum number of served persons per 5 minutes, maximum average destination time, maximum average waiting time or other measurable or calculable magnitudes and values statistically derived therefrom.

In that case, due to the risk of not being able to meet the simulated values in the realized installation, a safety range is to be added (risk allowance). This safety range is not to be selected to be too large, so as not to reduce the value of the guarantee certificate too strongly. The values ascertained by means of simulation are indicated as best estimation and somewhat diminished values are guaranteed.

The amount of the diminishing and the width of the safety range of the values of the best estimation are dependent on the magnitude taken into consideration and are determined on the basis of empirical values and statistical observations and/or methods, which take into consideration the possible differences between desired and actual performances or the causes thereof in simulations or other calculation methods. By way of example, possible faults, for example slower car or door movements than provided in the operating parameters, can be simulated or the effects thereof on the performance characteristics can be calculated. Performance characteristics which statistically vary more strongly are more strongly diminished. This can also be very differently emphasized depending on the respective operating parameters, for example in dependence on the elevator control.

The guarantee certificate is, in a preferred performance, provided with a falsification protection whereby it is ensured that it cannot be changed unnoticed. The protocol is thus clearly checkable with respect to its genuineness by means of a publicly available authentication procedure. This falsification protection is, for example, a numerical sequence which is calculated from one or more electronic documents and which is established in a written document. In that case the method for calculation of the numerical sequence preferably has the characteristic that it is generally known and that it is very difficult or impossible to achieve the same numerical sequence with different starting documents. A known such method is, for example, the MD5 message-digest algorithm (Network Working Group Request for Comments-RFC 1321).

The guarantee certificate is at least partly coded so that the customer does not know or has to know all data about the behavior of the elevator installation. This is of interest for the elevator company because details of operating parameters may involve business trade secrets. The disclosed data are selected so that the checkability of the guaranteed performance is sufficiently ensured.

A preferred solution of the problem appears as follows:

The guarantee certificate consists of an electronic file and of a written document, which both have a falsification protection which additionally confirms that they belong together.

The electronic file comprises the specifications, the guarantee declarations as well as the passenger traffic as a list of elevator calls per time instant and kind, for example "destination call at starting stop x with destination stop y at time instant T" in the case of a destination call control. Allocations of calls to cars and the car/door movements are not stored in the file.

The written document contains the same as the electronic file, but only a part of the passenger traffic, for example a randomly selected 15% of all elevator calls.

For the verification, the passenger traffic, i.e. the elevator calls, is input into the control of the elevator installation with the help of the electronic file. The behavior of the installation is established in a measurement protocol which also describes the allocation of calls to cars and the movements of cars and doors.

The written documents are, for example, signed in duplicate as part of the sale contract and exchanged between the elevator company and the customer. Depending upon the respective form of the falsification protection and/or the coding, the guarantee certificate is checked by a computer program with respect to its genuineness or intactness. In certain circumstances such a check program or parts thereof can be left to the customer so that the customer himself can at any time establish the genuineness or intactness without the customer thereby being able to uncover the coded parts.

In certain circumstances the measurement protocol is not completely accessible to the customer. The customer receives the list of all car and door movements as well as the car allocations of those calls that correspond with the part of the passenger traffic disclosed in the document. The customer himself has the possibility of observing the movements of cars and doors.

The elevator company ascertains from the measurement protocol the performance characteristics, which are described in the guarantee declarations, for the entire passenger traffic as well as for the part thereof disclosed in the document. The part disclosed in the document can be verified by the customer himself, who can be assisted, for example, by the elevator company with appropriate aids, for example an "Excel" program.

The check agreement can, for example, provide that not only the performance characteristics with respect to overall traffic, but also partial traffic must lie within the guarantee declarations. In this case the guarantee declarations are selected so that also an appropriate partial traffic has the highest probability of fulfilling these.

The described method steps have the character of an example and shall not exclude a similar or more general transposition of the described subject.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of forming a protocol for the operation of an elevator installation, comprising the steps of:

a) defining a protocol having at least one operating parameter for achieving a desired performance of an elevator installation;

b) determining the at least one operating parameter by at least one of simulation of the operation of the elevator installation and calculation;

c) including in the protocol a desired performance corresponding with the at least one operating parameter whereby the elevator installation is operable with the at least one operating parameter; and d) providing the protocol with a falsification protection in order to prevent at least one of the at least one operating parameter and the desired performance from being changed unnoticed.

2. The method according to claim 1 including providing the protocol with a guaranteed value for the desired performance of the elevator installation and comparing a measured actual performance of the elevator installation operated with the at least one operating parameter with the guaranteed value.

3. The method according to claim 1 including providing the protocol with a guaranteed value for the desired performance of the elevator installation, the guaranteed value being diminished relative to the desired performance by a predetermined factor.

4. The method according to claim 1 wherein the falsification protection permits the protocol to be unambiguously checked with respect to the genuineness thereof by use of a publicly available authentication procedure.

5. The method according to claim 1 including providing the protocol with expiration data which ensures that claims derived from the protocol are valid only for a restricted time period.

6. The method according to claim 1 including providing the protocol with a comparison of an actual performance of the elevator installation, which is operated with the at least one operating parameter, with the desired performance.

7. The method according to claim 1 including preventing disclosure of at least a part of the protocol to an unauthorized person.

* * * * *